US006772797B2

(12) United States Patent
Kikuchi

(10) Patent No.: US 6,772,797 B2
(45) Date of Patent: Aug. 10, 2004

(54) WEBBING FOR SEAT BELT AND METHOD OF MANUFACTURING WEBBING FOR SEAT BELT

(75) Inventor: Koichi Kikuchi, Shizuoka (JP)

(73) Assignee: Kikuchi Kogyo Co., Ltd., Shizuoka (JP)

( * ) Notice: Subject to any disclaimer, the term of this patent is extended or adjusted under 35 U.S.C. 154(b) by 0 days.

(21) Appl. No.: 10/213,895

(22) Filed: Aug. 7, 2002

(65) Prior Publication Data

US 2003/0111127 A1 Jun. 19, 2003

(30) Foreign Application Priority Data

Dec. 18, 2001 (JP) ..... 2001-384367

(51) Int. Cl.[7] ..... D03D 25/00

(52) U.S. Cl. ..... 139/426 R; 139/426 TW; 442/203; 297/464

(58) Field of Search ..... 139/426 R, 426 TW; 442/203; 297/464, 468, 469, 470, 471, 473, 483

(56) References Cited

U.S. PATENT DOCUMENTS 3,296,062 A * 1/1967 Truslow ..... 442/203
3,322,163 A * 5/1967 Hughes ..... 139/383 R
5,592,977 A * 1/1997 Kikuchi et al. ..... 139/387 R
5,634,499 A * 6/1997 Kikuchi et al. ..... 139/387 R
5,881,939 A * 3/1999 Kikuchi et al. ..... 226/180
5,952,250 A * 9/1999 Kim et al. ..... 442/203
6,071,835 A * 6/2000 Tang et al. ..... 442/216

FOREIGN PATENT DOCUMENTS

JP 62-46672 3/1987
JP 5-35870 5/1993

* cited by examiner

*Primary Examiner*—John J. Calvert
*Assistant Examiner*—Robert H. Muromoto, Jr.
(74) *Attorney, Agent, or Firm*—Greer, Burns & Crain, Ltd.

(57) ABSTRACT

A thin and light webbing having a high strength per warp yarn unit, maintaining abrasion resistance, and using, as a warp yarn, a very strong polyester multifilament yarn for a seat belt made by fine single-yarn fibers. A yarn obtained by performing a twisting process of a high degree of twist is used as a warp yarn. The polyester multifilament yarn of fine single-fibers is essential to be woven at the maximum stretch ratio in a yarn making process to obtain a very-strong polyester fiber for a seat belt. A multifilament yarn and/or a monofilament yarn of polyester is/are used as weft yarns. By making the weft yarns and warp yarns cross each other so as to be woven in a belt like configuration, a webbing having a very high strength per unit of warp yarns, using low-cost base yarns, and maintaining abrasion resistance is obtained.

9 Claims, 3 Drawing Sheets

WEBBING FOR SEAT BELT AND METHOD OF MANUFACTURING WEBBING FOR SEAT BELT

BACKGROUND OF THE INVENTION

1. Field of the Invention

The present invention relates to webbing for a seat belt, which is woven in a belt like configuration by making warp yarns cross with weft yarns.

More particularly, the invention relates to a technique of obtaining a thin and light webbing having a high strength per unit numbers of warp yarns and maintaining abrasion resistance, which is woven by using, as warp yarns, polyester multifilament yarns each made by very-strong, fine single filament yarn which are not typically used in a conventional seat belt and are highly twisted very much with a twisting condition, unlike in the conventional seat belt.

2. Description of Related Arts

Generally, a webbing for a seat belt has specifications assuring characteristics such as specified tensile strength, elongation, and durability or the like, and it mainly uses, as warp yarns, multifilament yarns made of polyester or polyamide filament yarns or fibers and, as weft yarns, multifilament yarns or monofilament yarns made of polyester or polyamide filament yarns of fibers, and is woven into a belt like narrow fabric by making the warp and weft yarns intercrossed with each other on a loom for a narrow fabric.

Conventionally, most of webbings are woven into a belt like narrow fabric on a power loom for a narrow fabric by making warp and weft yarns intercrossed with each other by reciprocating a shuttle for weft yarns along a shedding portion provided within the warp yarns and formed by an upper warp yarn group and a lower warp yarn of the total warp yarn group and separated from each other, on the loom.

During the weaving operation of the power loom for a narrow fabric, due to abrasion to the warp yarn group by the shuttle for weft yarns which passes through the shedding portion formed by the upper warp yarn group and a lower warp yarn of the warp yarns on the loom, damage such as a breakage in a filament often occurs on the warp yarn group.

To prevent the breakage in a filament of the warp yarn group, conventionally, a multifilament yarn made of polyamide, which has a single yarn fineness of about 8 deniers and a strength thereof being about 8 g per denier and is twisted up to about 80 turns/m, had been generally used as a warp yarn in a webbing.

After that, a weaving process for making webbing by utilizing a needle loom for a narrow fabric has become popular. In the weaving, by reciprocating a needle for weft yarns along the shedding portion formed by separated upper warp yarn group and lower warp yarn group on the loom, the warp yarns and the weft yarns are intercrossed with each other so as to farm a belt like configuration.

Abrasion to the warp yarn group caused by the needle for weft yarns, which passes through within the shedding portion formed by the separated upper warp yarn group and lower warp yarn group, on the loom, during the weaving operation by the needle loom for narrow belt like fabric, is much smaller than that to the warp yarns caused by the shuttle for weft yarns used in a power loom.

Therefore, without maintaining binding characteristics of yarns by giving certain numbers of twist in the warp yarns, the damages such as the breakage in a filament does not occur so much on the warp yarn group. Consequently, the tendency of reducing the cost of a webbing by eliminating the coat of the twisting process by skipping the twisting process of the warp yarns, which is conventionally performed, became stronger.

Further, along with the above-mentioned tendency of not performing the twisting process, a new method for sec wing abrasion resistance of a webbing by performing a surface finishing process using a resin, oil, or the like on the webbing woven by using, as warp yarns, multifilament yarns of which single yarn fineness is large, was created and this technique has been often used.

As a result, it became common to use, as a warp yarn, a multifilament yarn made of polyamide or polyester, almost without being twisted, and having a single yarn fineness of about 11 deniers and a strength of about 8.5 g per denier.

Note that, recently, a polyester fiber is used in most of webbings and thus it becomes a mainstream in manufacturing a webbing, to weave a webbing on a needle loom for a narrow fabric by using, as a warp yarn, a polyester multifilament yarn having a single yarn fineness of about 11 deniers and a strength of about 9 g per denier.

Further, recently, with advance in the technique of making polyester yarns in which the yarn can maintain conventional yarn strength although a single yarn fineness thereof is large, and in which filaments are seldomly broken, in order to omit a surface finishing process to the yarns for maintaining abrasion resistance of the webbing, there is a tendency to further enlarge the mingle yarn fineness of a fiber used for a warp yarn in the webbing.

It is recommended to use, as a warp yarn in a webbing, a polyester multifilament yarn having a single yarn fineness of about 14 deniers and a yarn strength of about 9 g per denier with an almost no-twist.

As in the transition of the conventional technique, the needle loom for a narrow fabric has come to be generally used for weaving of webbing. As the yarn-spinning technique advances and as a fiber manufacturer has come to be able to supply a polyester multifilament which is hardly broken and has a large single yarn fineness, that was difficult to be achieved in the past, the webbing manufacturing technique has been shifted to the direction of omitting the process of twisting the warp yarn in a webbing to reduce the cost of the webbing and of increasing the fineness of a single yarn of a polyester filaments or fibers used for a warp yarn to secure abrasion resistance by omitting a surface finishing treatment process.

On the other hand, the higher the drawing ratio of a filament or fiber becomes, the higher the strength becomes. On the contrary, occurrence of breakages in a filament increases.

As the fineness of a single yarn is increased, the drawing process in a yarn spinning process becomes difficult. It is that the yarn speed of yarn spinning process decreases to keep a predetermined quality.

Even by utilizing the present yarn-spinning technique which is the to be highly advanced, it is very difficult to further improve the strength of the fiber by increasing the drawing ratio or to further reduce the cost of a source yarn by increasing the yarn-spinning speed without increasing the occurrence of failures, for example, generation of yarn break or the like in the filament of the polyester multifilament yarn or fiber having an increased single yarn fineness which is being often used recently as the warp yarn in a webbing.

On the other hand, in a weaving process, a polyester multifilament yarns having a large single yarn fineness and almost without being twisted, is used for the warp yarns in a webbing.

Therefore, the drawback caused by yarn breakages in the filaments becomes a drawback of a webbing in that a cut cad portion of a single filament or fiber having a relatively large fineness is projected from the surface of the woven webbing, and is apparent as a failure in the appearance of the webbing.

From the viewpoint of suppressing a failure in the webbing, frequent occurrence of the failure of yarn breakages in the filament in the yarn-making process cannot be accepted, while, it is difficult to pursue reduction in the cost of the source yarn by increasing the strength of the filament or the fiber or by increasing the yarn-making speed.

Therefore in the direction of the recent webbing weaving technique of increasing the fineness of a single yarn as well as of omitting the process of twisting the polyester yarns used for the warp yarns of a webbing, it is difficult to reduce the cost of the source yarn by improving the speed of spinning a yarn in the yaw-spinning process or to reduce the cost of the source yarn by improving the strength of the source yarn by increasing the drawing ratio. The techniques have reached the highest limit and the next task is to develop a novel technique to look for a remarkable breakthrough on this matter.

SUMMARY OF THE INVENTION

It is therefore an object of the invention to overcome the above-mentioned problems in the past and to provide a thinner, lighter, and cheaper webbing having a capability of reducing a certain number of warp yarns therein, as well as having a higher strength per unit number of warp yarns and a higher tensile strength, which enables polyester multifilament yarns having very high levels of yarn strength and comprising a plurality of single polyester filaments having very fine fineness, to be used as warp yarns of the webbing without deteriorating abrasion resistance of the webbing.

To achieve the object of the present invention, the invention basically employs technical configurations as described below.

As a first aspect of the present invention, there is provided a webbing for a seat belt, which comprises warp yarns and weft yarns, and wherein polyester multifilament yarns having a yarn strength of 10 g/denier or more, and each comprising a plurality of polyester single filaments, each having a single filament fineness of 7 denier or less in average and further each one of the polyester multifilament yarns being twisted with a twist coefficient $\alpha$ of 4000 or more, the twist coefficient $\alpha$ being obtained by the following equation (1), are used for main ground warp yarns of the webbing, and further wherein the webbing being woven by the warp yarns and the waft yarns and utilizing a weft yarn density which satisfies a relationship between the weft yarn density and a fineness of the weft yarn as defined by the following equation (2), $$\alpha = T \times (D1)^{1/2} \quad (1)$$

(where T denotes a number of twist t/m, and D1 indicates a denier of multifilament yarn as used for the warp yarns); and As a second aspect of the present invention, there is provided a method of manufacturing webbing for a seat belt, which comprising the steps of:

arranging a plurality of polyester multifilament yarns, each comprising a plurality of polyester multifilament yarns having a yarn strength of 10 g/denier or more, and each comprising a plurality of polyester single filaments each having a single filament fineness of 7 denier or less in average and further each one of the polyester multifilament yarns being twisted with a twist coefficient $\alpha$ of 4000 or more, the twist coefficient $\alpha$ being defined by the above-mentioned equation 1, as at least one part of the ground warp yarns of the webbing;

supplying the polyester multifilament yarns to a weaving process with twisting same simultaneously; and weaving the webbing with the polyester multifilament yarns as the warp yarns and predetermined yarns as the weft yarns.

Since the webbing for a seat belt and the method of manufacturing a webbing for seat belt in the present invention employs the above-described technical configuration, a thinner, lighter, and cheaper webbing having a capability of reducing a certain number of warp yarns therein, as well as having a higher strength per unit number of warp yarns and a higher tensile strength, which enables polyester multifilament yarns having very high levels of yarn strength and comprising a plurality of single polyester filaments having, very fine fineness to be used as warp yarns of the webbing without deteriorating abrasion resistance of the webbing can be easily obtained.

In the present invention, a polyester multifilament having a single-yarn fineness being remarkably much smaller than that used for a warp yarn recently and generally, which contains therein a plurality of polyester yarns having relatively high level of yarn fineness, and specifically, a polyester multifilament yarn containing therein a plurality of polyester filament yarn each having a single yarn fineness of 7 deniers or less and the yarn having a much higher yarn strength, specifically, a strength of 10 g/denier or higher is used as a warp yarn in a webbing.

The yarn having a smaller single-yarn fineness can be produced in a filament spinning process with a drawing ratio higher than that as used in the conventional yarn spinning process and thus the polyester filament yarns having a yarn strength being much higher than that of the conventional one, can be used as a warp yarn.

And further, the yarn can be produced at a higher speed, and the polyester filament yarn, by which cost can be largely reduced, can be used as a warp yarn of webbing. Therefore, the strength of a webbing can be improved by increasing the strength of the warp yarn of the webbing or the cost of the webbing can be reduced by reducing the amount of warp yarns as used in a webbing and by reducing in the price of the source yarn.

In the invention, by heavily twisting the polyester multifilament yarn as the warp yarn having very small single-yarn fineness, the twisting operation being not commonly performed in a conventional seat belt manufacturing process the warp yarn can have a strong binding characteristic. Consequently, since the warp yarn for the webbing is relatively bound strongly, without performing a special surface treatment process, abrasion resistance of webbing can be maintained. Obviously, there is no problem if a surface treatment process was also performed.

Further, in the invention, it is possible to roll the cut end portion of the filament which was broken due to a high drawing ratio applied to the filament in the filament drawing process or a high-speed yarn-spinning operation in the yarn spinning process, into among single filament yarns thus twisted, so as to be hidden thereamong, and so that the cut end of the filament can not be remarkably projected from the surface of the webbing.

In such a manner, a drawback in the appearance of a surface of the webbing can be reduced. As the number of twist should be used in the present invention, in order to keep the strength retention at around 80% or higher, even after an abrasion test with a hexagonal bar according to the JIS standard had been completed and which is generally used as a reference, the twist coefficient α obtained by the following equation (1) has to be 4000 or higher.

$$\alpha = T \times (D1)^{1/2} \quad (1)$$

(where T denotes the number of twist t/m, and D1 indicates denier of a warp multifilament yarn)

The present invention is further characterized by employing a twisting process means in that very low processing cost for performing a twisting process on a warp yarn is applied thereto, for example, a twisting process in that in performing a warping process or weaving process by using, for example, a "creel having a twisting apparatus" as shown in the Japanese Patent No. 2,514,884 or a "creel having a double twisting apparatus" as shown in the Japanese Patent No. 2,630,567, a process of twisting the warp yarn of a webbing is carried out simultaneously therewith.

By doing this, a yarn twisting process, which is eliminated for reducing the cost, can be employed again as a new embodiment in a webbing manufacturing technique. The flexibility of selecting a single-yarn fineness of a source yarn which can be used or a permissible range of a defect of breakage in a filament which occurs in the yarn making process, can be expanded by several times with reference to those of the conventional ones.

Further, in the present invention, from the viewpoints of the hexagonal bar abrasion characteristic with respect to weft yarns for a webbing in which the above-mentioned warp yarns are used for the warp yarns thereof, stability of configuration for a webbing or the like, a webbing is woven with weft yarns with a weft yarn density so that the relation between a density and a thickness of weft yarns satisfies the following equation (2) (which is defined as a weft yarn coefficient, hereafter)

$$\text{weft yarn density (weft yarns/3 } cm) \times (D2)^{1/3} > 175 \quad (2)$$

(where D2 denotes total deniers of the multifilament yarn and/or a monofilament as weft yarns).

In the invention, when the weft yarn coefficient is 175 or less, the strength retention after abrasion test with a hexagonal bar becomes 80% or less, so that a webbing having poor hexagonal bar abrasion resistance and many numbers of crossing points formed by a weft yarn and a warp yarn in the webbing may be easily deviated, is obtained.

By weaving a webbing by using, as weft yarns, the polyester monofilament yarn and/or the polyester multifilament yarn, the hardness (rigidity) in the width direction of the webbing is adjusted to obtain comfortableness when the user wears the webbing, or roll up characteristic or reversing characteristic of the webbing when the webbing is taken up by a take-up apparatus, can be prevented.

By properly selecting the fineness of the weft yarn in the range where the weft yarn coefficient is satisfied and by changing the thickness of the webbing, the heat resistance of the webbing can be adjusted so as to prevent melting deterioration in the webbing due to high-speed friction between the webbing and a metal fitting for guiding the webbing or between the webbing and a human body at the time of collision.

A polyester multifilament yarn having a single-yarn fineness, a single yarn strength and the number of twist different from those of the polyester multifilament yarn as mentioned above or a multifilament yarn made of a material other than polyester can be used as a part of warp yarns.

Further, by inserting one or a plurality of the warp yarns having a relatively small fineness to both end portions of the webbing, the shape of the end portions of the webbing is made almost round or cylindrical. Thus, the webbing having the ends which are soft can be provided. To identify an external appearance of a webbing, one or a plurality of the above-mentioned warp yarns may be inserted to an optional part of warp yarns. By changing the weaving construction of a part of warp yarns forming a webbing, the portion of the webbing having a different weaving construction from that of the main portion of the webbing can be used as a mark enabling to identify a webbing having a different specifications form standard ones.

DETAILED DESCRIPTION OF THE PREFERRED EMBODIMENTS

Figure 1:
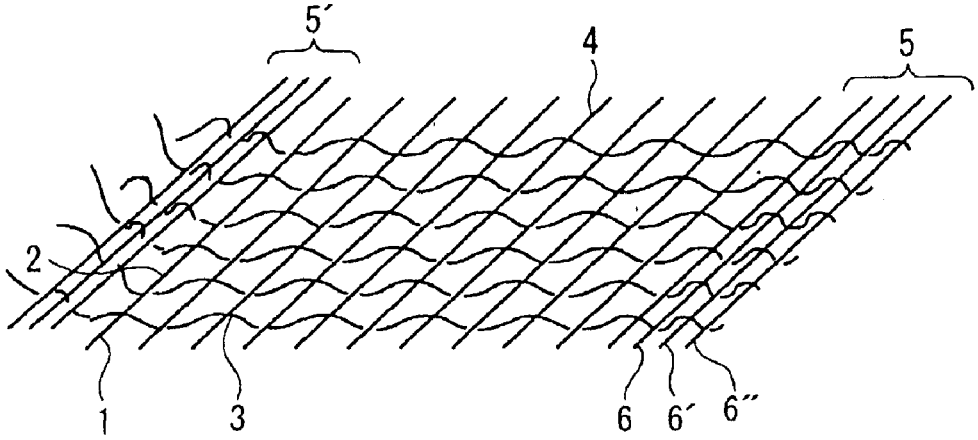
FIG. 1 is a diagram for explaining the outline of the configuration of a webbing for a seat belt in the present invention.

The configuration of an embodiment of the webbing for a seat belt and the method of manufacturing the webbing for a seat belt in the present invention will be described in detail by referring to the drawings.

FIG. 1 is a diagram showing the configuration of an embodiment of the webbing for a seat belt in the present invention. FIG. 1 shows a webbing 4 for a seat belt characterized by woven with using, as main ground warp yarns 2, a plurality of polyester multifilament yarns 1 each being twisted with a twist coefficient α of 4000 or more, the twist coefficient α being obtained by the following equation (1);

$$\alpha = T \times (D1)^{1/2} \quad (1)$$

(where T denotes the number of twist t/m, and D1 indicates denier of a warp multifilament yarn);

the multifilament yarn 1 being obtained by gathering a plurality of single polyester filament yarns each having a single-yarn fineness of 7 deniers or less and the multifilament yarn 1 having a strength of 10 g/denier or higher, and the webbing 4 being woven by the warp yarns 2 and the weft yarns 3 with utilizing a weft yarn density which satisfies a relationship between the weft yarn density and a fineness of the weft yarn 3 as defined by the following equation (2);

$$\text{weft yarn density (weft yarns/3 } cm) \times (D2)^{1/3} > 175 \quad (2)$$

(where D2 denotes total deniers of the multifilament yarn and/or a monofilament as weft yarns).

In the equation (1) used in the present invention, the twist coefficient α is expressed as the product of the twist number T (t/m) of the multifilament yarn 1 and the square root of the denier (D1) of the multifilament yarn 1 used as the warp yarn 2.

In the equation (2) used in the present invention, the relation between the density of the weft yarns 3 and the total denier of the multifilament yarn and/or the monofilament yarn used as a weft yarn is expressed as the product of the weft yarn density (the number of yarn ends/3 cm) and the cube root of the denier (D2) of the weft yarn.

In the present invention, preferably, the webbing 4 for a seat belt is woven by a needle loom.

Further, in the present invention, preferably, a single yarn strength of the polyester multifilament yarn 1 serving as the main ground warp yarns 2 is 9 g/denier or higher, after the webbing 4 for a seat belt had been subjected to either one of a dyeing process, a heat setting process, or a finishing process.

Further, in the present invention, the polyester multifilament yarn and/or the polyester monofilament yarn may be used as weft yarns.

In the webbing 4 for a seat belt according to the present invention, preferably, as warp yarns 6 forming a selvage portion 5 in the webbing for a seat belt, multifilament yarns having a fineness being smaller than that of the multifilament yarn 1 as used for the main ground warp yarns 2, can be used.

As an embodiment of a method of manufacturing a webbing for a seat belt in the present invention, the method has the step of weaving a webbing by using, as at least a part of the main ground warp yarns of a fabric, a plurality of polyester multifilament yarns are supplied to a weaving process so as to weave a webbing, while each one of the polyester multifilament yarns being suffered from a twisting operation whereby each one of the polyester multifilament yarns being twisted with a predetermined twist coefficient $\alpha$ of more than 4000, the twist coefficient $\alpha$ being defined as mentioned above, and the multifilament yarn being obtained by gathering a plurality of polyester single filaments having a single yarn fineness of 7 deniers or less and the multifilament yarn having a yarn strength of 10 g/denier or higher, and supplying the polyester multifilament yarn while twisting the polyester multifilament yarn to a weaving step.

As a more preferred embodiment of the method of manufacturing a webbing for a seat belt according to the present invention, a plurality of bobbins having a not-twisted polyester multifilament yarn thereon, are mounted auto a creel having a proper twisting mechanism as warp yarn supplying means, the polyester multifilament yarn as the warp yarn as withdrawn from each of the plurality of bobbins mounted on the creel, and simultaneously therewith is twisted and thereafter, the twisted warp yarns are supplied to a warping process, while supplying the warped warp yarns to a weaving process so as to weave a webbing.

Further, as another embodiment of the method of manufacturing a webbing for a seat belt according to the present invention, the method includes the steps of mounting a plurality of bobbins having a not-twisted polyester multifilament yarn thereon, onto a creel having a proper twisting mechanism as warp yarn supplying means, twisting each one of the polyester multifilament yarns as the warp yarns pulled from each of the plurality of bobbins mounted on the creel, and simultaneously therewith supplying the warp yarns to a coarse fabric weaving step to form a coarse-woven fabric, and supplying a warp yarn a part of the coarse-woven fabric, to a weaving step, thereby weaving the webbing.

The present invention will be described in more detail by the following examples.

EXAMPLE 1

200 of polyester multifilament yarns, each having 1500 deniers with 288 filaments (having a single yarn fineness of 5.2 deniers) and having a strength of 10.5 g/d were used as a polyester multifilament yarn having a small single-yarn fineness and used for warp yarns 1 of a webbing in the present invention.

By using a creel as disclosed in Japanese Patent No. 2,630,567, a twisting process was performed so as to give variously different number of twist to the same warp yarns as mentioned above, respectively, and simultaneously with performing the twisting operation, each of the twisted yarns were supplied to a needle loom, respectively as warp yarns for a webbing.

By doing this, 750-denier polyester multifilament yarns were supplied into the above-mentioned warp yarns on the same needle loom, as weft yarns 3, at a weft yarn density of 20 weft yarns/3 cm (weft yarn coefficient: 182), thereby forming a coarse gray woven webbing with rough weft yarn density. Finally, a dyeing process and a resign finishing process ware performed on this webbing, and accordingly, a plurality of kinds of webbings A to F, as shown in Table 1 were formed.

As comparative examples, webbings G and H in Table 1 were formed by a similar processing method by using, as a warp yarn, a polyester yarn of 1500 deniers with 144 filaments (having a single yarn fineness of 10.4 deniers) and having a large single-yarn fineness, which is recently generally used as a warp yarn of a webbing.

Figure 2:
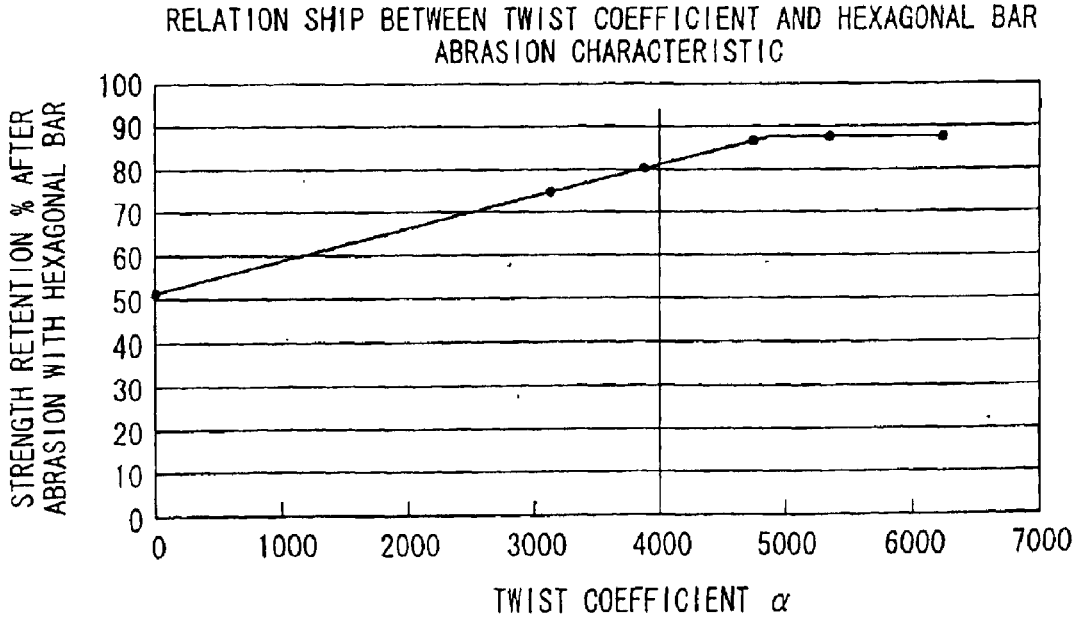
FIG. 2 is a graph showing the relation between a twist coefficient and a strength retention after abrasion test with a hexagonal bar.

From the result, it is understood that, by twisting the warp yarn with a twist coefficient ($\alpha$) of 4,000 or higher, as shown in FIG. 2, an excellent webbing, having a JIS standard hexagonal bar abrasion strength retention of 80% or higher, can be formed. It is also understood that by performing such a twisting process, as shown in Table 1, a drawback of surface fluff can be also suppressed to a preferable level.

EXAMPLE 2

Polyester multifilament yarns, each having 1260 deniers with 192 filaments (having a single yarn fineness of 6.6 deniers) and having a strength of 10.8 g/d were used as a polyester multifilament yarn having a small single-yarn fineness and used for warp yarns 1 of a webbing in the present invention.

By using a creel as disclosed in Japanese Patent No. 2,630,567, a twisting process was performed so as to give the warp yarns a twisting number of 120 t/m, and simultaneously with performing the twisting operation, the twisted yarns were supplied to a needle loom, as warp yarns for a webbing.

In the weaving operation, a coarse woven webbing is formed by the needle loom with the above-mentioned warp yarns 1 and weft yarns 3 and when the coarse webbing is produced by the needle loom, a plurality of the coarse webbings J to R bad been formed by changing the number of weft yarns, the kind of weft yarns, and the fineness and density of the weft yarns, as shown in Table 2.

Some webbings were subjected to only, while some webbings were subjected to a dyeing process and a resign finishing process.

As a comparative example, a webbing S in Table 2 using, as a warp yarn, a polyester yarn of 1260 deniers with 108 filaments (having a single-yarn fineness of 11.7 deniers), having a strength of 9 g/d which is recently generally used as a warp yarn of a webbing was used as the warp yarn.

From the result, it is understood that, as compared with the comparative example S which is generally used as a webbing of a 30 kN type at present, webbings of examples L, M, P, Q, and R each formed with the fineness of a weft yarn at a weft yarn density so that the weft yarn coefficient defined above in the present invention becomes 175 or higher, have excellent performances, and are thin and a weight thereof being lighter than that of conventional webbing, by 14 to 19%.

In contrast, webbings of comparative examples J, K, and N have, due to an insufficient weft yarn coefficient, poor hexagonal bar abrasion resistance and cross-points formed by a weft yarn and a warp yarn in a webbing may be easily deviated.

The webbing of the example R using a 600-denier polyester monofilament as a weft yarn, is a product having a lateral rigidity which being about twice as high as that of the webbing of the example P.

Figure 3:
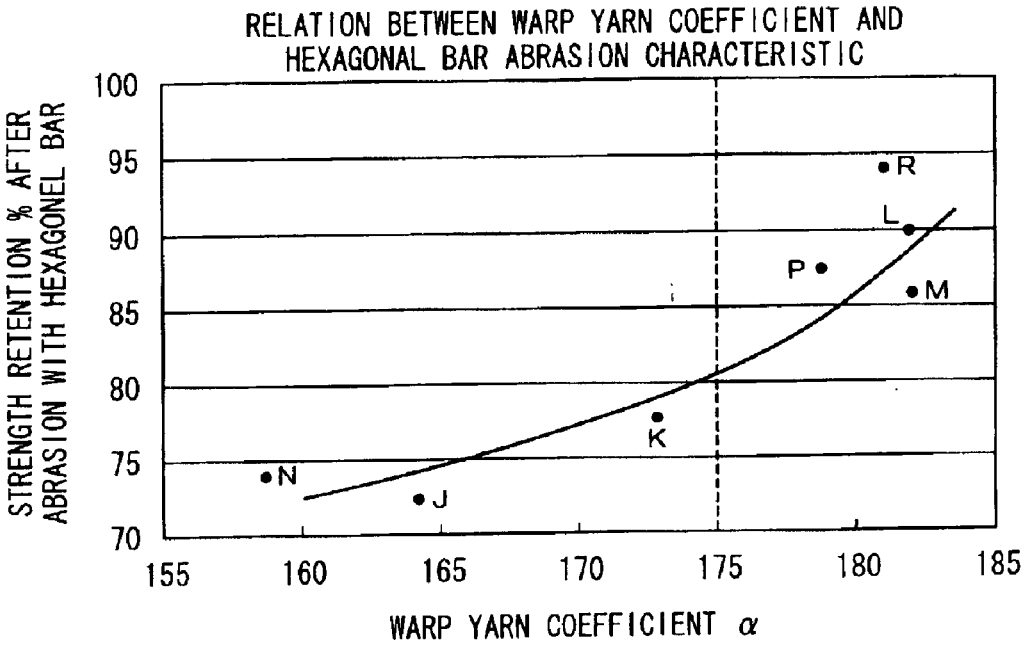
FIG. 3 is a graph showing the relation between a weft yarn coefficient and a strength retention after abrasion test with a hexagonal bar.

Further, the relationship between the strength retention after abrasion test with a hexagonal bar and the weft yarn coefficient draws a specific curve as shown in FIG. 3, and it is regarded that a relationship showing a data existing closely around the graph shown by the curve would be ideal. It is understood that when the weft yarn coefficient is 175 or higher, a product satisfying the purpose of the present invention can be obtained.

EXAMPLE 3

A group of 16 polyester multifilament yarns, each having 500-denier and 48-filament and twisted at about 120 t/m, and a group of 16 polyester multifilament yarns, each having 250-denier and 24-filament and twisted at about 120 t/m, were inserted into one end portion 5 of the webbing 4, respectively, as warp yarns 6 thereof, and the same groups of the above-mentioned yarns were also inserted into an opposite end portion 5' of the webbing 4, respectively, as warp yarns 6 thereof, in addition to the warp configuration of a webbing as shown in the example D of the present invention.

Figure 4:
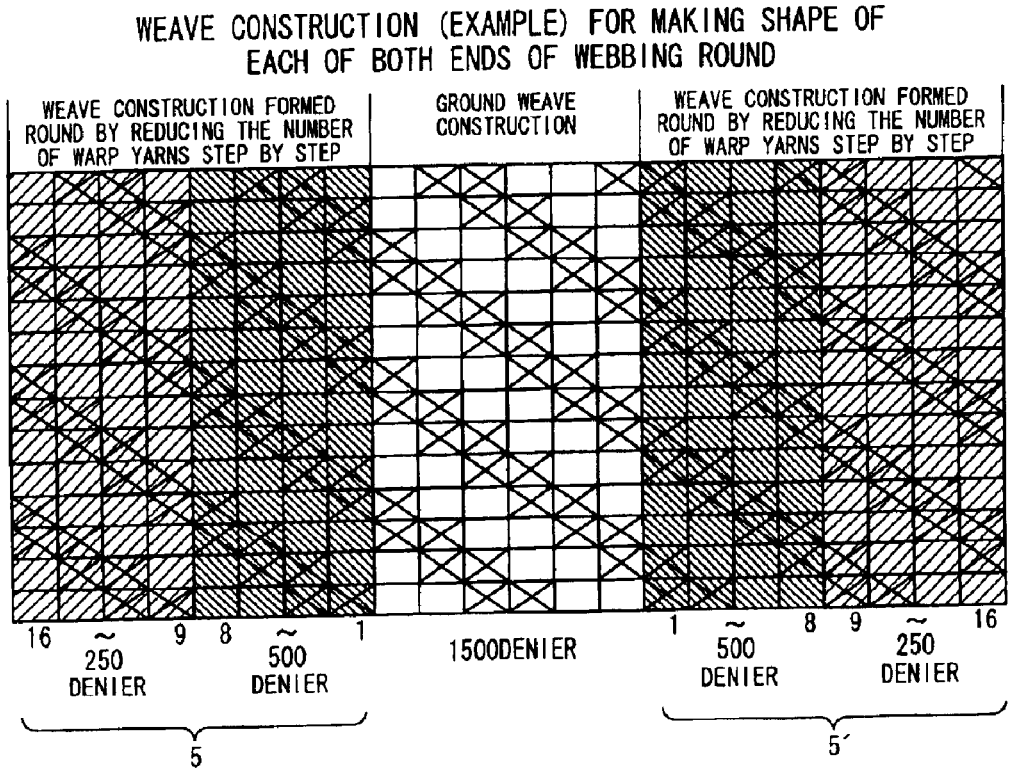
FIG. 4 is a diagram showing an example of a weaving construction for making the shapes of both end portions of a webbing round.

Thereafter, these warp yarns were woven with a suitable weft yarns into a webbing with a predetermined weaving construction as shown in FIG. 4, so that a configuration of both end portions of the webbing can show almost round shape and soft feeling.

In another embodiment, a group of 32 polyester multifilament yarns, each being 500-denier and 48-filament and being twisted at about 120 t/m, were inserted into both end portions 5 and 5' of the webbing 4, respectively, as warp yarns 6 thereof, in addition to the warp configuration of a webbing as shown in the example D of the present invention.

Figure 5:
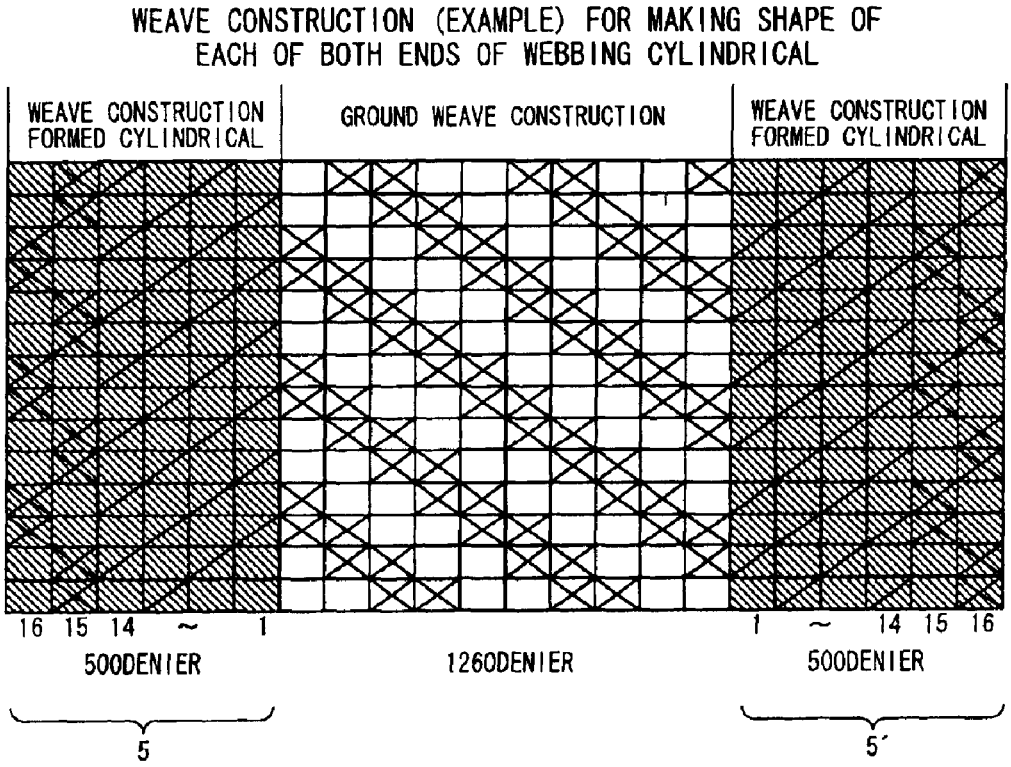
FIG. 5 is a diagram showing an example of a weaving construction for making the shapes of both ends of a webbing cylindrical.

Thereafter, these warp yarns were woven with a suitable weft yarns into a webbing with a predetermined weaving construction as shown in FIG. 5, so that a configuration of both end portions of the webbing can show almost cylindrical shape and soft feeling.

The webbing for a seat belt and the method of manufacturing the webbing for a seat belt in the present invention has the above-described configuration.

Therefore, a novel twisting method of very-low processing cost for performing a twisting process on a warp yarn while performing a warping or weaving process by using, for example, a "creel having a twisting apparatus" of Japanese Patent Application No. 2,514,884 or a "creel having a double twisting apparatus" of Japanese Patent Application No. 2,630,567, can be obtained.

By using this, a twisting process of giving a high twisting number which is not common in a conventional seat belt to the warp yarns of a webbing, is performed and thereby enabling the novel very-strong polyester multifilament yarn made of fine single-yarn filaments which are not common for the conventional seat belt, and which are made with a maximum yarn spinning speed with a maximum high drawing ratio in the spinning process to be used as warp yarns of the webbing.

Thus, the webbing having a very high strength per unit number of warp yarns, with reduced cost of the source yarns, and maintaining abrasion resistance can be obtained.

Further, in the present invention, by strongly twisting the warp yarn in a webbing so as to giving a highly binding characteristic to the warp yarn, which is not performed by the conventional technique, it is possible to roll up the cut end of a filament which is generated by breakage on a single filament yarn during a yarn spinning process, into twist of the yarn so as to be hidden and so that the end of the filament is not projected from the surface of the webbing.

In such a manner, a drawback in the appearance of a webbing can be reduced.

By not only reduction in the drawback of the webbing but also allowance of an increase in cut in the filaments in the yarn making process, the drawing ratio of the yarn and the yarn-spinning speed are further increased. Consequently, stronger and cheaper base yarns can be used, and increase in the strength per unit number of warp yarns and reduction in the cost of the webbing can be achieved.

In the embodiment, by inserting a plurality of warp yarns having a relatively fine fineness to both end portions of the webbing, the shape of the end portions of the webbing are made almost round or cylindrical. Thus, a comfortable shape of a selvage portion of the webbing, like soft ends thereof, can be assured.

In the present invention, by selecting the shape (multifilament or monofilament) or the yarn fineness (diameter of filament or a yarn) of a filament in a weft yarn in a webbing, the hardness (rigidity) in the width direction of the webbing can be adjusted to obtain comfortableness when the user wears the webbing, or overturn or twist of the webbing when the webbing is taken up by a take-up apparatus can be prevented.

Further, in the present invention, by changing the thickness of the webbing, the heat resistance of the webbing can be adjusted in order to prevent melting deterioration in the webbing due to high-speed friction between the webbing and a metal fitting for guiding the webbing or between the webbing and a human body at the time of collision.

TABLE 1

| | Comparative Example A | Comparative Example B | Comparative Example C | Example D | Example E | Example F | Comparative Example G | Comparative Example H |
|---|---|---|---|---|---|---|---|---|
| Warp yarn | | | 1500d-288f | | | | 1500d-144f | |
| Number of warp yarns (ends) | | | 200 | | | | 200 | |
| Number of twist of warp Yarn (t/m) | 0 | 80 | 100 | 120 | 140 | 160 | 0 | 80 |
| Warp yarn twist Coefficient (α) | 0 | 3098 | 3873 | 4678 | 5422 | 6197 | 0 | 3098 |
| Weft yarns/pic | | | 750d/20 pic | | | | 750d/20 pic | |
| Thickness (m/m) | 0.93 | 0.96 | 0.96 | 0.96 | 0.96 | 0.97 | 0.98 | 1.00 |
| Weight (g/m) | 41.6 | 42.1 | 42.2 | 42.2 | 42.4 | 42.6 | 41.9 | 42.3 |
| Tensile strength (kN) | 26.4 | 26.3 | 26.3 | 26.2 | 26.0 | 25.6 | 24.7 | 24.5 |
| Abrasion with hexagonal bar (JIS) Strength Retention (%) | 51.1 | 74.0 | 79.5 | 86.1 | 87.0 | 87.0 | 62.8 | 85.0 |
| Surface fluff (pieces/2000 m) | 30 | 5 | 5 | 3 | 3 | 3 | 1 | 0 |

TABLE 2

| | Comparative Example J | Comparative Example K | Example L | Example M | Comparative Example N | Example P | Example Q | Example R | Comparative Example S |
|---|---|---|---|---|---|---|---|---|---|
| Warp yarn | | | | 1260d-192f | | | | | 1260d-108f |
| Number of warp yarns (ends) | | | 280 | | | | 252 | 280 | 325 |
| Number of twist of warp yarn (t/m) | | | | 120 | | | | | 0 |
| Multifilament as weft yarn 1 | 750d | | | | 500d | | 750d | 500d | 500d |
| Picking number of welf yarn 1 (pic/3 cm) | 18 | 19 | 20 | 20 | 20 | 22.5 | 20 | 17.5 | 22.5 |
| Monofilament as weft yarn 2 | — | — | — | — | — | — | — | 600d | — |
| Picking number of weft yarn 2 (pic/3 cm) | — | — | — | — | — | — | — | 17.5 | — |
| Weft yarn coefficient* | 164 | 173 | 182 | 182 | 159 | 179 | 182 | 181 | 179 |
| Resin finishing | no | no | no | done | no | no | done | done | done |
| Thickness (mm) | 1.02 | 1.03 | 1.04 | 1.03 | 1.00 | 0.99 | 0.99 | 1.00 | 1.14 |
| Weight (g/m) | 47.2 | 47.6 | 48.1 | 48.2 | 46.2 | 46.4 | 44.0 | 46.2 | 57.4 |
| Tensile strength (kN) | 31.2 | 30.5 | 30.4 | 30.2 | 30.5 | 30.5 | 27.4 | 30.5 | 30.4 |
| Abrasion with hexagonal bar (JIS) Strength retention (%) | 72.3 | 77.9 | 90.3 | 86.1 | 74.0 | 87.8 | 86.3 | 94.0 | 90.0 |
| Lateral rigidity (Gurley rigidity) (mN) | — | — | — | — | — | 1.36 | — | 2.59 | — |

Remark:
weft yarn coefficient* denotes weft yarn density (yarns/3 cm) × D2(1/3)

What is claimed is:

1. A webbing for a seat belt, comprising:

warp yarns including main ground warp yarns; and weft yarns, wherein said main ground warp yarns of said webbing are composed of polyester multifilament yarns, and further wherein said webbing is woven by said warp yarns and said weft yarns utilizing a weft yarn density which satisfies a relationship between said weft yarn density and a fineness of said weft yarn as defined by weft yarn density (ends/3 cm)×$(D2)^{1/3}$>175 where D2 denotes a total denier of multifilament yarn or mono-filament yarn or both of said multifilament and mono-filament yarns used for said weft yarns;

where polyester multifilament yarns comprising a plurality of polyester single filaments, each filament having a yarn strength of 10 g/denier or more, and each filament having an average single filament fineness of 7 denier or less, each of said polyester multifilament yarns twisted with a twist coefficient α of 4000 or more, said twist coefficient α obtained by $$\alpha = T \times (D1)^{1/2},$$

where T denotes a number of twist per meter t/m, and D1 indicates a denier of said multifilament yarns used for said warp yarns.

2. The webbing for the seat belt according to claim 1, wherein the webbing is woven on a needle loom.

3. The webbing for the seat belt according to claim 1 or 2, wherein a single filament yarn strength of said polyester multifilament yarn forming at least apart of said main ground warp yarns of said webbing is 9 g/denier or higher after said webbing treated with one of a dyeing process, a heat setting process, and a finishing process.

4. The webbing for the seat belt according to claim 1, wherein polyester multifilament yarns, polyester monofilament yarns or both of said polyester multifilament and polyester monofilament yarns are used as weft yarn of said webbing.

5. The webbing for the seat belt according to claim 1, wherein multifilament each having a fineness thereof being smaller than that of the multifilament yarn used in said main ground warp yarns are used as warp yarns forming a selvage portion in the webbing for the seat belt.

6. A method of manufacturing a webbing for a seat belt, comprising the steps of:

arranging a plurality of polyester multifilament yarns as at least one part of ground warp yarns of said webbing, each comprising a plurality of polyester multifilament yarns having a yarn strength of 10 g/denier or more and a plurality of polyester single filaments each having a single filament average fineness of 7 denier or less, and further each one of said polyester multifilament yarns being twisted with a twist coefficient $\alpha$ of 4000 or more, said twist coefficient $\alpha$ being obtained by, $$\alpha = T \times (D1)^{1/2},$$

where T denotes a number of twist per meter t/m, and D1 indicates a denier of said multifilament yarns used far said warp yarns;

supplying said polyester multifilament yarns to a weaving process while simultaneously twisting said polyester multifilament yarns; and weaving said webbing with said polyester multifilament yarns as the warp yarns, and predetermined yarns as weft yarns.

7. The method at manufacturing the webbing for the seat belt according to claim 6, wherein said weft yarns are inserted into an array of said warp yarns with a weft yarn density defined by, $$\text{weft yarn density (ends/3 cm)} \times (D2)^{1/3} > 175$$

where D2 denotes a total denier of multifilament or mono-filament yarn or both of said multifilament and mono-filament yarns used for said weft yarns.

8. The method of manufacturing the webbing for the seat belt according to claim 6, further comprising the steps of:

mounting a plurality of bobbins containing thereon a not-twisted polyester multifilament yarn onto a creel having a proper twisting mechanism as warp yarn supplying means;

withdrawing each of said polyester multifilament yarns serving as said warp yarns, from each of said plurality of bobbins mounted on the creel, respectively, mad twisting said polyester multifilament yarns during said yarn withdrawing process;

successively supplying thereafter said twisted polyester multifilament warp yarns to a warping process; and successively supplying said warped polyester multifilament warp yarns to a weaving process to weave said webbing.

9. The method of manufacturing the webbing for the seat belt according to claim 6, further comprising the steps of:

mounting a plurality of bobbins containing thereon a not-twisted polyester multifilament yarn onto a creel having a proper twisting mechanism as warp yarn supplying means;

withdrawing each one of said polyester multifilament yarns serving as said warp yarns, from each of said plurality of bobbins mounted on the creel, respectively, and twisting said polyester multifilament yarns during said yarn withdrawing process;

successively supplying thereafter said twisted polyester multifilament warp yarns to a coarse fabric producing process so as to form a coarse fabric; and successively supplying said warp yarns which a part of said coarse fabric, to a weaving process so as to produce a webbing.

* * * * *

UNITED STATES PATENT AND TRADEMARK OFFICE

CERTIFICATE OF CORRECTION

PATENT NO. : 6,772,797 B2
DATED : August 10, 2004
INVENTOR(S) : Kikuchi

It is certified that error appears in the above-identified patent and that said Letters Patent is hereby corrected as shown below:

Column 2,
Line 6, delete "sec wing" and insert -- securing --.

Column 3,
Line 2, delete "cad" and insert -- end --.
Line 17, delete "yaw-spinning" and insert -- yarn-spinning --.
Line 59, insert the following paragraph:
-- Weft yarn density (ends/3 cm) X $(D2)^{1/3}$ >175 (2)
(Where D2 denotes a total denier of multifilament yarn or monofilament yarn or both as used for the weft yams). --.

Column 4,
Line 19, delete "having," and insert -- having -- (delete comma).

Column 7,
Line 49, delete "auto" and insert -- onto --.
Line 51, delete "warp yarn as" and insert -- warp yarn is --.

Column 9,
Line 1, delete "bad" and insert -- had --.

Column 12,
Line 57, delete "$\alpha = {}^{Tx}(Dl)^{1/2}$" and insert -- $\alpha = T \times (D1)^{1/2}$ --.
Line 66, delete "apart" and insert -- a part --.

Column 13,
Line 2, delete "webbing treated" and insert -- webbing is treated --.
Line 6, delete "weft yarn" and insert -- weft yarns --.
Line 39, delete "method at" and insert -- method of --.

Column 14,
Line 13, delete "warp yarns," and insert -- warp yarns -- (delete comma).
Line 14, delete "respectively mad" and insert -- respectively and --.
Line 30, delete "warp yarns," and insert -- warp yarns -- (delete comma).
Line 38, delete "coarse fabric," and insert -- coarse fabric --(delete comma).

UNITED STATES PATENT AND TRADEMARK OFFICE

CERTIFICATE OF CORRECTION

PATENT NO. : 6,772,797 B2
DATED : August 10, 2004
INVENTOR(S) : Kikuchi

It is certified that error appears in the above-identified patent and that said Letters Patent is hereby corrected as shown below:

Columns 11 and 12,
Please delete TABLES 1 and 2 in their entirety, and insert the following tables as shown on the attached sheets.

Signed and Sealed this

Nineteenth Day of April, 2005

JON W. DUDAS
*Director of the United States Patent and Trademark Office*

TABLE I

| | Comparative Example A | Comparative Example B | Comparative Example C | Example D | Example E | Example F | Comparative Example G | Comparative Example H |
|---|---|---|---|---|---|---|---|---|
| Warp yarn | 1500d-288f | | | | | | 1500d-144f | |
| Number of warp yarns (ends) | 200 | | | | | | 200 | |
| Number of twist of warp Yarn (t/m) | 0 | 80 | 100 | 120 | 140 | 160 | 0 | 80 |
| Warp yarn twist Coefficient (α) | 0 | 3098 | 3873 | 4678 | 5422 | 6197 | 0 | 3098 |
| Weft yarns/pic | 750d/20pic | | | | | | 750d/20pic | |
| Thickness (m/m) | 0.93 | 0.96 | 0.96 | 0.96 | 0.96 | 0.97 | 0.98 | 1.00 |
| Weight (g/m) | 41.6 | 42.1 | 42.2 | 42.2 | 42.4 | 42.6 | 41.9 | 42.3 |
| Tensile strength (kN) | 26.4 | 26.3 | 26.3 | 26.2 | 26.0 | 25.6 | 24.7 | 24.5 |
| Abrasion with hexagonal bar (JIS) Strength Retention (%) | 51.1 | 74.0 | 79.5 | 86.1 | 87.0 | 87.0 | 62.8 | 85.0 |
| Surface fluff (pieces/2000m) | 30 | 5 | 5 | 3 | 3 | 3 | 1 | 0 |

TABLE 2

| | Comparative Example J | Comparative Example K | Example L | Example M | Comparative Example N | Example P | Example Q | Example R | Comparative Example S |
|---|---|---|---|---|---|---|---|---|---|
| Warp yarn | 1260d-192f | | | | | | | | 1260d-108f |
| Number of warp yarns (ends) | 280 | | | | | | 252 | 280 | 325 |
| Number of twist of warp yarn (t/m) | 120 | | | | | | | | 0 |
| Multifilament as weft yarn 1 | 750d | | | | 500d | | 750d | 500d | 500d |
| Picking number of welf yarn 1(pic/3cm) | 18 | 19 | 20 | 20 | 20 | 22.5 | 20 | 17.5 | 22.5 |
| Monofilament as weft yarn 2 | - | - | - | - | - | - | - | 600d | - |
| Picking number of weft yarn 2(pic/3cm) | - | - | - | - | - | - | - | 17.5 | - |
| Weft yarn coefficient* | 164 | 173 | 182 | 182 | 159 | 179 | 182 | 181 | 179 |
| Resin finishing | no | no | no | done | no | no | done | done | done |
| Thickness (mm) | 1.02 | 1.03 | 1.04 | 1.03 | 1.00 | 0.99 | 0.99 | 1.00 | 1.14 |
| Weight (g/m) | 47.2 | 47.6 | 48.1 | 48.2 | 46.2 | 46.4 | 44.0 | 46.2 | 57.4 |
| Tensile strength(kN) | 31.2 | 30.5 | 30.4 | 30.2 | 30.5 | 30.5 | 27.4 | 30.5 | 30.4 |
| Abrasion with hexagonal bar (JIS) Strength retention(%) | 72.3 | 77.9 | 90.3 | 86.1 | 74.0 | 87.8 | 86.3 | 94.0 | 90.0 |
| Lateral rigidity (Gurley rigidity)(mN) | - | - | - | - | - | 1.36 | - | 2.59 | - |

Remark:

weft yarn coefficient* denotes weft yarn density (yarns/3 cm)×D2(1/3)